US007901011B2

(12) United States Patent
Holl et al.

(10) Patent No.: US 7,901,011 B2
(45) Date of Patent: Mar. 8, 2011

(54) MILLING DRUM FOR A CONSTRUCTION MACHINE, CONSTRUCTION MACHINE AS WELL AS GEARBOX UNIT FOR A MILLING DRUM

(75) Inventors: Bernd Holl, Neustadt/Wied (DE); Stefan Abresch, Elgert (DE); Thomas Lehnert, Oberraden (DE)

(73) Assignee: Wirtgen GmbH (DE)

( * ) Notice: Subject to any disclaimer, the term of this patent is extended or adjusted under 35 U.S.C. 154(b) by 1013 days.

(21) Appl. No.: 11/727,989

(22) Filed: Mar. 29, 2007

(65) Prior Publication Data

US 2007/0228806 A1 Oct. 4, 2007

(30) Foreign Application Priority Data

Mar. 31, 2006 (DE) ..... 10 2006 015 506

(51) Int. Cl.
*E01C 23/88* (2006.01)

(52) U.S. Cl. ..... 299/39.4

(58) Field of Classification Search ..... 299/39.1, 299/39.4, 39.8

See application file for complete search history.

(56) References Cited

U.S. PATENT DOCUMENTS 4,242,020 A * 12/1980 Schmid ..... 409/234
4,755,001 A * 7/1988 Gilbert ..... 299/39.8

FOREIGN PATENT DOCUMENTS

EP 1 194 651 B1 7/2000
EP 1 520 076 B1 4/2003

* cited by examiner

*Primary Examiner* — John Kreck
(74) *Attorney, Agent, or Firm* — Waddey & Patterson, P.C.; Lucian Wayne Beavers

(57) ABSTRACT

In a milling drum (2) for a construction machine, in particular a road milling machine (1) or a recycler, with an interchangeable milling tube (4) arranged coaxially to the axis (20) of the milling drum, where the milling tube (4) is supported, by means of a support ring (8), on a support ring mount (12) of a rotating body coupled to a milling drum drive (16), it is provided that the support ring (8) and the support ring mount (12) of the rotating body display several complementary supporting surfaces (22, 24) arranged coaxially to the axis (20) of the milling drum, where the said supporting surfaces (22, 24) have different supporting circle diameters and are arranged behind one another axially with their diameters decreasing incrementally in the pulling direction.

38 Claims, 6 Drawing Sheets

MILLING DRUM FOR A CONSTRUCTION MACHINE, CONSTRUCTION MACHINE AS WELL AS GEARBOX UNIT FOR A MILLING DRUM

BACKGROUND OF THE INVENTION

The invention concerns a milling drum and a construction machine, as well as a gearbox unit for a milling drum.

It is often necessary, due to varying job site situations and milling operations, to adapt the milling tool of a road milling machine to the specific tasks at hand. A milling drum with a particular spacing of the cutting tools or a different tooling is required when, for instance, a specific surface texture is to be achieved. In another application, only specific carriageway widths are to be removed, which requires a milling drum with a particular working width.

As a rule, a special milling machine has to be employed in these situations, or else the machine must be equipped with a milling drum adapted to the task at hand. Exchanging the milling drums presently involves a lot of effort, however, and requires special aids for the assembly or disassembly of the milling drum.

Milling drums for road milling machines or recyclers are known from EP 1194651 B and EP 1520076 B where the milling drum displays an interchangeable milling tube with the axis of the said milling tube being supported, by means of a support ring, on a support ring mount of a rotating body coupled to a milling drum drive. The support ring sits on the support ring mount with a predetermined play where dirty water, dust and fine particles of the road surface can penetrate the gap between the support ring and the support ring mount, in particular due to relative movements between the support ring and the support ring mount resulting from the milling operation. The capillary attraction of the clearance fit intensifies this effect, so that dirty water and fine-grained particles penetrate the fit.

When the milling tube with the support ring is to be pulled from the support ring mount for the purpose of disassembly, this is often very difficult or not possible at all.

Disassembly is not easy in view of the given dimensions, namely with a support ring that is short in relation to the diameter of the milling drum when seen in axial direction, even though the assembly in a cleaned state can also prove to be difficult due to tilting.

Supporting surfaces of conical design have also turned out not to be practicable as they can, on the one hand, settle too strongly and, on the other hand, display excessive radial play when the milling drum to be pushed on is too short. A conically designed supporting surface would, therefore, require the conical support ring and support ring mount to be positioned within an accuracy range of +/−1 mm in order to enable a function at all, in which case the problem of a conical connection being prone to seizing will persist nevertheless.

The purpose of the invention is, therefore, to simplify the assembly and disassembly of the milling tube in milling drums with interchangeable milling tubes, in construction machines with milling drums and in gearbox units driving a milling drum.

The characteristics of this application serve to provide a solution to this purpose.

SUMMARY OF THE INVENTION

The invention provides in an advantageous manner that the support ring and the support ring mount of the rotating body display several complementary supporting surfaces arranged concentrically to the axis of the milling drum, where the said supporting surfaces have different supporting circle diameters and are arranged behind one another axially with their diameters decreasing incrementally in the pulling direction.

Due to the staircase-shaped design of the supporting surfaces of the support ring and the support ring mount, the milling tube has to be pulled off in an amount corresponding to the width of one step only to disengage the support ring with the support ring mount, this being achieved without reducing the overall area of the supporting surface. With a fivefold step, for instance, the distance required to separate the supporting surfaces from one another can be reduced to one fifth of the total axial length of the supporting surface.

It is of particular advantage here that the effective supporting surface for the milling tube remains practically the same.

In one preferred embodiment, a minimum number of three, preferably five supporting surfaces are arranged behind one another axially.

The supporting surfaces arranged behind one another axially have a length of 5 to 40 mm, preferably 10 to 20 mm. This creates a stable supporting surface for a milling tube of a milling drum.

The length of a supporting surface may be equal in axial direction. This offers the advantage that, when pulling, all supporting surfaces are disengaged simultaneously.

Alternatively, the supporting surfaces may also have different lengths in axial direction, and preferably in such a manner that the length of the supporting surfaces decreases in accordance with the decreasing supporting circle diameter. This offers the advantage, in particular during assembly, that not all of the supporting surfaces are engaged simultaneously, which may facilitate assembly.

Another preferred embodiment provides that the supporting surfaces of the support ring are offset axially in relation to the supporting surfaces of the support ring mount when seen in the pulling direction of the milling tube, in such a manner that annular chambers are formed at the junctions of the individual steps.

The annular chambers may be used in an advantageous manner to be filled with an anti-corrosive agent or a lubricant.

For this purpose, the annular chambers may be connected with an injection duct that is suitable for the purpose of injecting an anti-corrosive agent and/or lubricant. The injection duct may, for instance, display a nipple for injecting grease.

The supporting surfaces may be coated with a gliding layer to facilitate assembly and disassembly.

The support ring mount may comprise a single-part ring or may also be integral with the rotating body. The single-part support ring mount may, for instance, be pushed onto the rotating body and secured there axially.

Alternatively, the support ring mount may be integral with the rotating body whereby the number of components can be reduced.

An alternative embodiment provides that the support ring mount comprises a multi-part, preferably two-part ring that is suitable for being mounted on the rotating body. Such support ring mount is advantageous when a support ring mount is not capable of being pushed onto the rotating body.

The support ring mount is mounted on the rotating body in an immovable manner axially, forming a floating bearing. The support ring mount can be secured to the rotating body at different positions axially.

An advantageous continuation of the invention provides that the rotating body is a basic drum body for supporting the milling tube and/or an output housing of a gearbox unit of the milling drum drive.

When mounted on two sides, the axis of the milling tube can, on the one hand, be mounted in a removable side wall and, on the other hand, rest upon the support ring mount of the rotating body by means of the support ring, wherein the milling tube can be pulled from the support ring mount of the rotating body in the pulling direction after the side wall has been removed.

An advantageous continuation provides that the basic drum body is coupled with the milling drum drive and supports the end of the milling tube facing the side wall.

A further advantageous continuation of the invention provides that a push-off device engages with the milling tube or with the rotating body, which permits the milling tube to be pulled from its mounted position in the pulling direction for the purpose of disassembly. The push-off device may be provided either mechanically or hydraulically.

Furthermore, it is provided in a particularly advantageous manner that the supporting surfaces with different supporting circle diameters, arranged behind one another axially, show a chamfer of, for instance, less than 45° at the junctions of the individual steps. This chamfer allows the milling tube to be centred more easily during assembly, thus facilitating the assembly. Preferably, a chamfer of less than 45° is used.

In the following, embodiments of the invention are explained in more detail with reference to the drawings. The following is shown:

DESCRIPTION OF THE PREFERRED EMBODIMENTS

Figure 1:
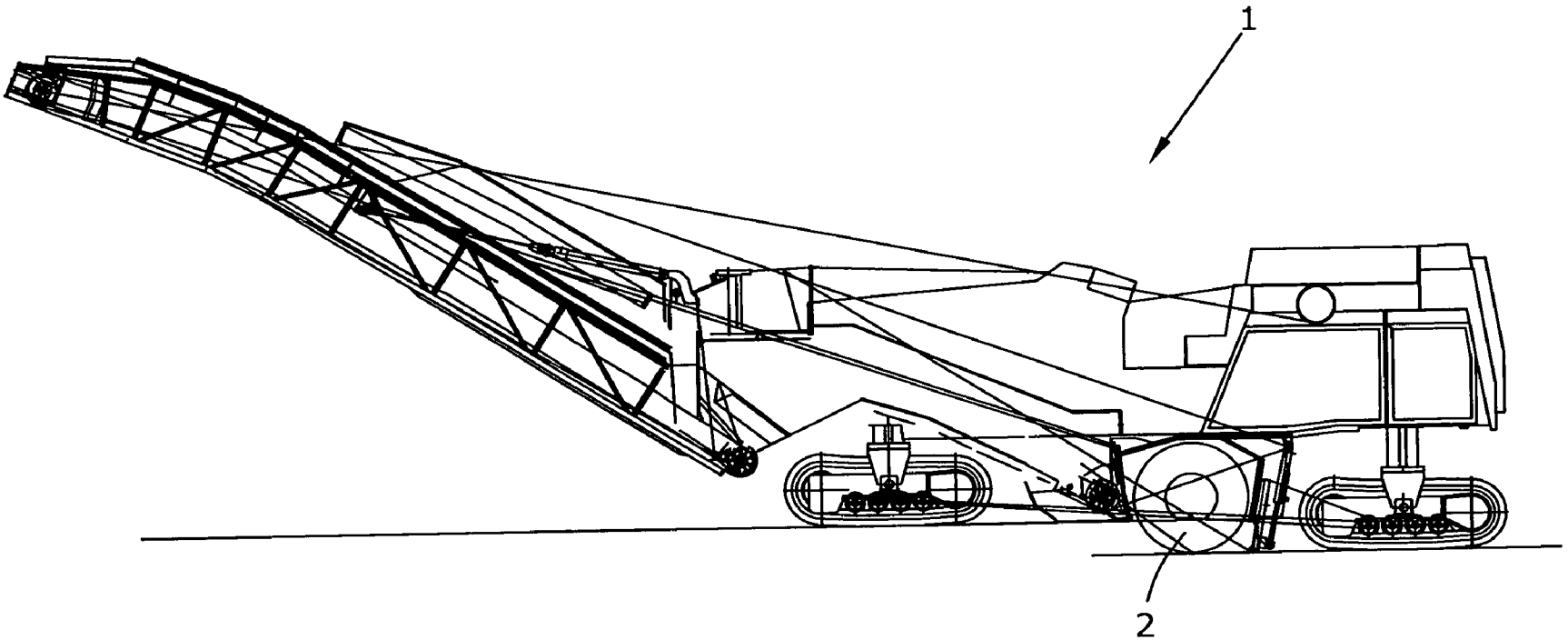
FIG. 1 a road construction machine.

FIG. 1 depicts a road construction machine 1 in which a quick-change system for milling tubes can be used.

The road construction machine is a road milling machine which commonly has a machine frame, with a combustion engine and operator's platform being mounted on said machine frame. The automotive road construction machine has height-adjustable lifting columns attached to the machine frame, with support wheels or crawler track units being mounted at the said lifting columns.

The milling drum 2 is located below the machine frame in a drum housing 9 that displays the side walls 13, 15 at the sides. The reference mark 7 indicates the cutting outline of the tools located on the milling drum 2. The material processed by the milling drum 2 is discharged on a first loading conveyor or is transported further onto a second, height-adjustable and slewable loading conveyor in a basically known manner.

Figure 2:
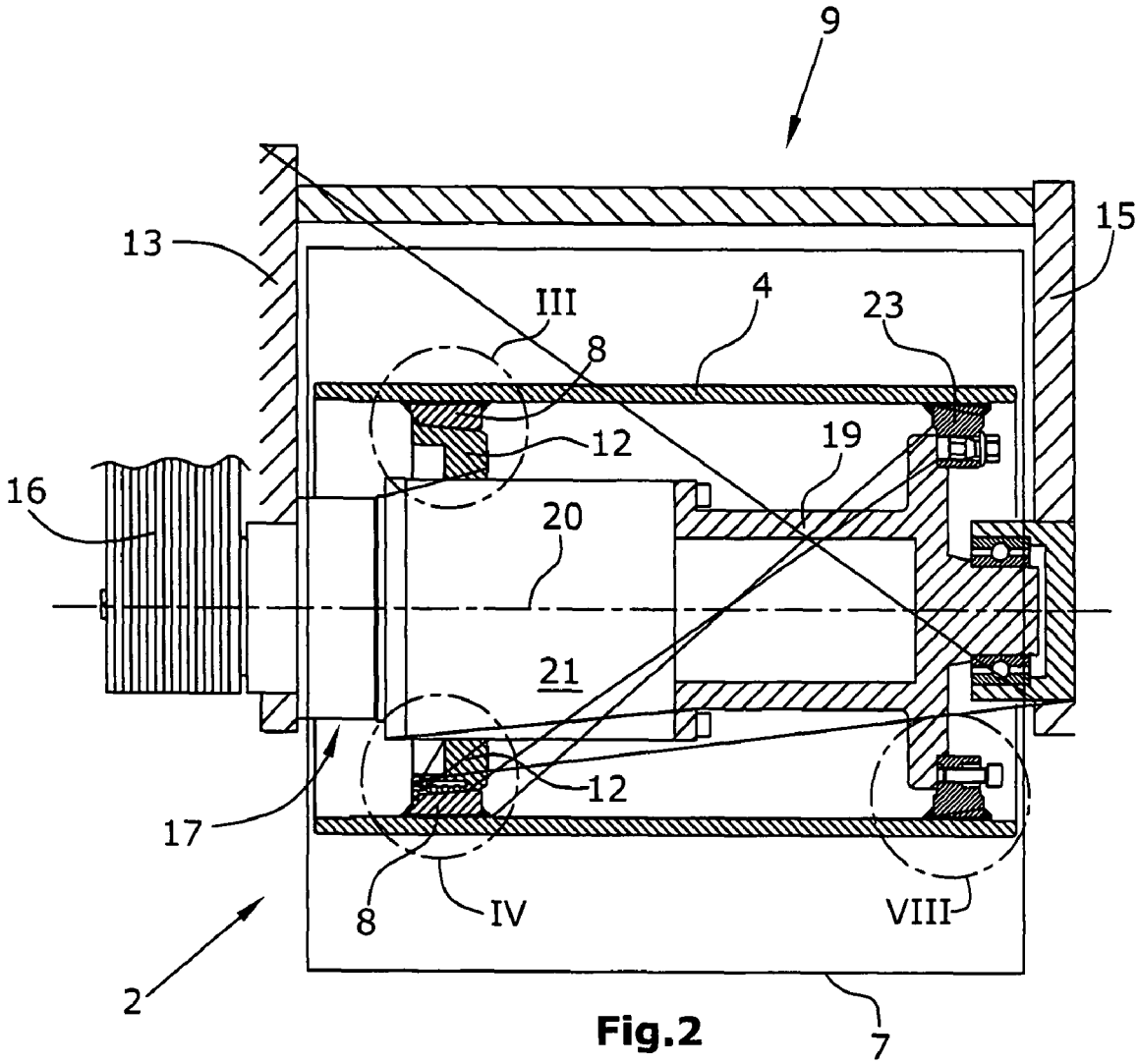
FIG. 2 a milling drum mounted on both sides.

In FIG. 2, a milling drum 2 is mounted in a rotatable manner between side walls 13, 15 of the drum housing 9, where the said side walls 13, 15 are arranged orthogonal to the axis 20 of the milling drum 2, and where the said milling drum 2 is driven via a driving device 16, mounted at the side wall 13 on the drive side, and a gearbox unit 17. The milling drum 2 depicted in FIG. 2 comprises an integral milling tube 4, which is attached to a basic drum body 19 in an interchangeable manner. The basic drum body 19 is in turn attached to the output housing 21 of the gearbox unit 17. The basic drum body 19 is arranged axially at the side of the output housing 21, transferring the torque of the gearbox unit 17 to the particular milling tube 4 inserted in the manner of a reduction gear.

The milling drum drive 16 preferably comprises a belt drive.

In FIG. 2, the milling tube 4 is bolted to the basic drum body 19 by way of an annular flange 23 which is in turn mounted in the removable side wall 15 in a rotatable manner. A support ring 8 is arranged on the side of the milling tube 4 facing the milling drum drive 16, where the said support ring 8 is connected to the milling tube 4 in a non-rotatable manner and co-operates with a support ring mount 12 sitting on top of the output housing 21.

The support ring 8 and the support ring mount 12 display several complementary supporting surfaces 22, 24 arranged concentrically to the axis 20 of the milling drum, where the said supporting surfaces 22, 24 have different supporting circle diameters and are arranged behind one another axially with their diameter decreasing incrementally in the direction of the side wall 15. In the embodiments, five supporting surfaces, for instance, are arranged behind one another axially. In the embodiments presented, the axial length of the supporting surfaces 22, 24 is 15 mm. It can vary, however, depending upon the diameter of the milling drum 2, between 5 and 40 mm and preferably between 10 and 20 mm.

The embodiments show that all supporting surfaces 22, 24 are of the same length axially. They may, however, also have different lengths, and preferably in such a manner that the length of the supporting surfaces 22, 24 decreases in accordance with the decreasing supporting circle diameter.

Figure 3:
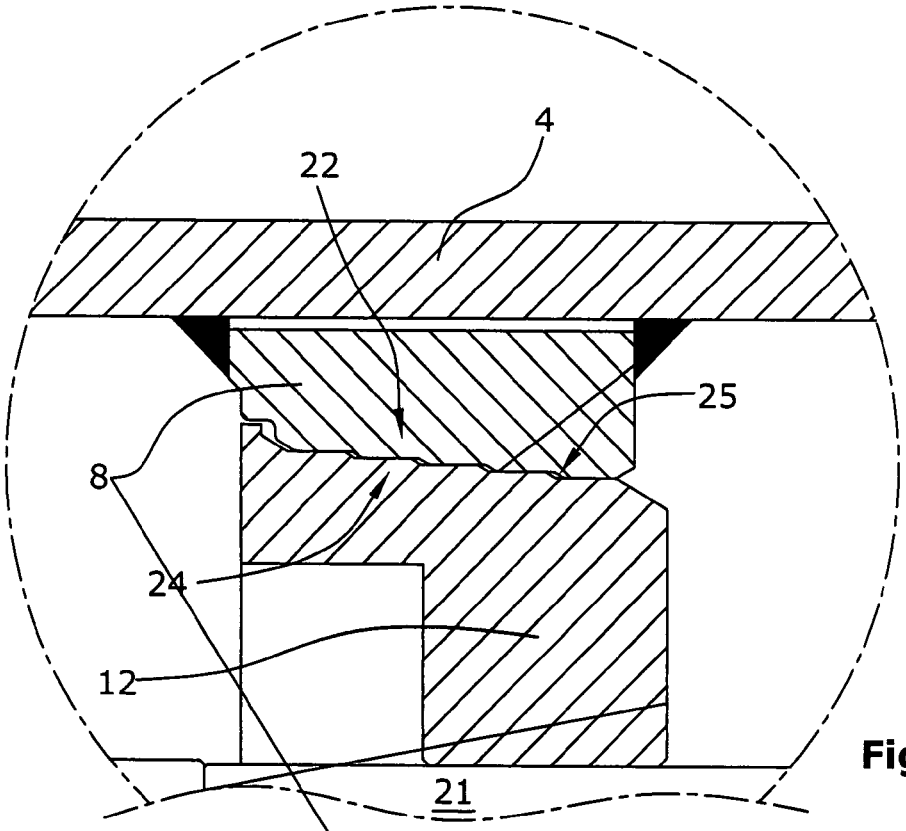
FIG. 3 the supporting surfaces of the support ring and the support ring mount, lying on top of each other, in accordance with detail III in FIG. 2.
Figure 4:
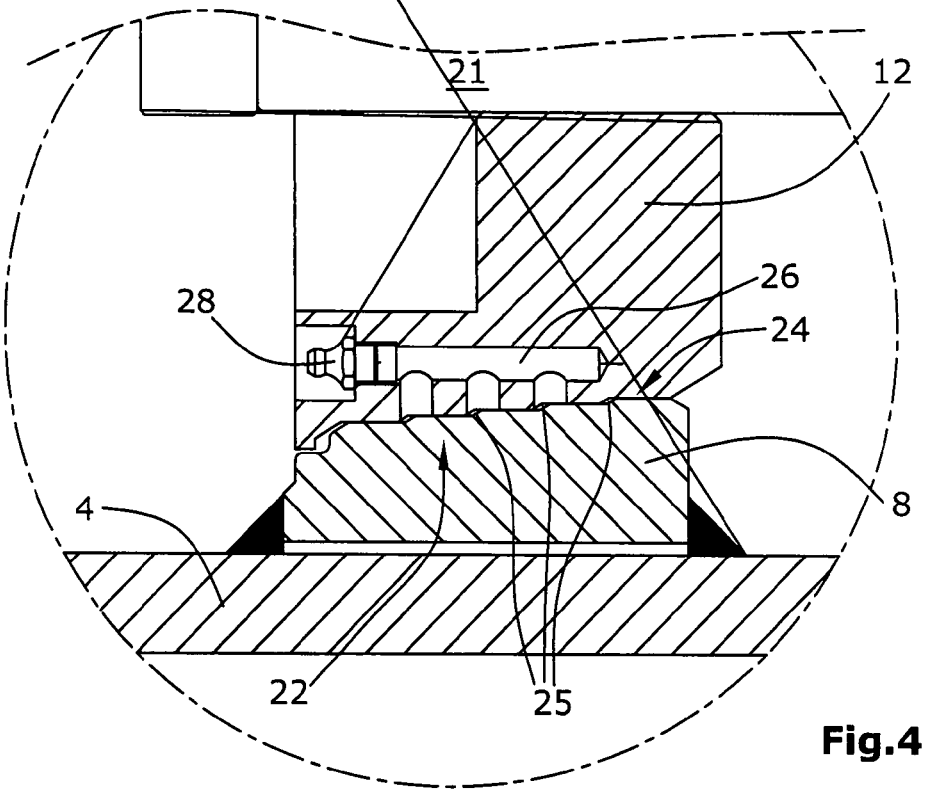
FIG. 4 an alternative embodiment of a support ring mount with grease lubrication.

As can best be seen from FIGS. 3 and 4, the supporting surfaces 22 of the support ring 8 are offset axially in relation to the supporting surfaces 24 of the support ring mount 12 when seen in the direction of the side wall 15, and in such a manner that annular chambers 25 are formed at the junctions of the individual steps. The annular chambers 25 may be filled with an anti-corrosive agent and/or a lubricant. As can be seen from FIG. 4, an injection duct 26 may be provided where, as can be seen from FIG. 3, the said injection duct 26 may be used to supply at least three annular chambers 25 with, for instance, grease via a grease nipple 28.

Figure 9:
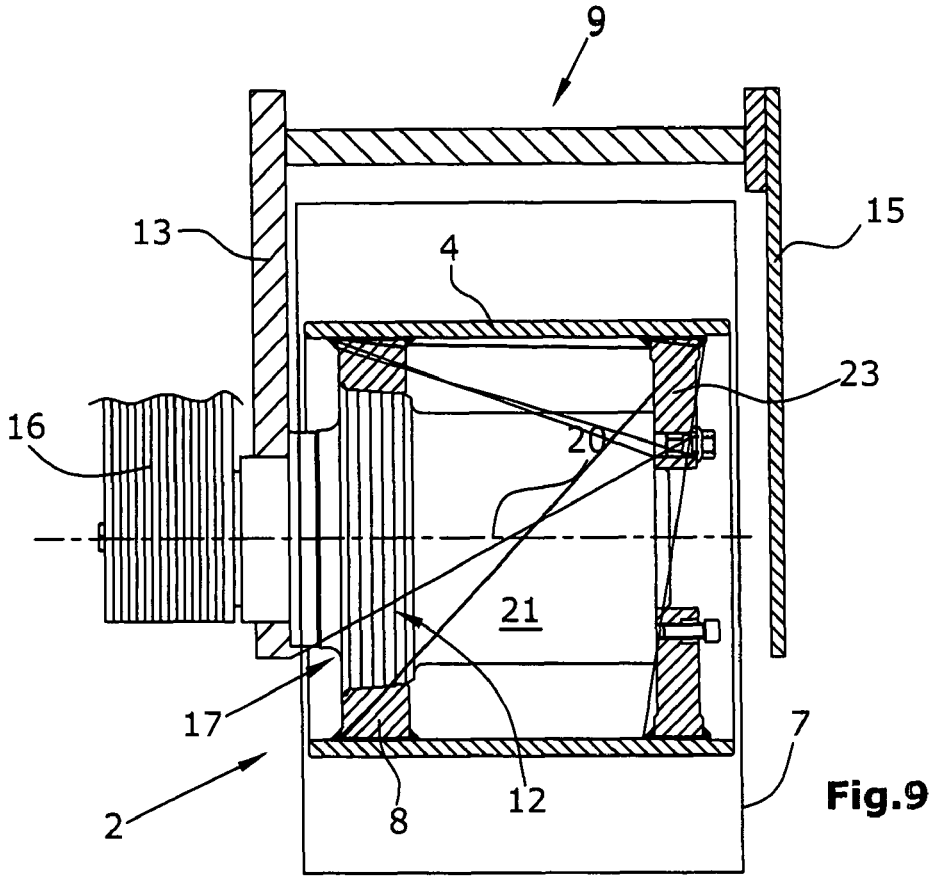
FIG. 9 a further embodiment for mounting a milling tube.
Figure 10:
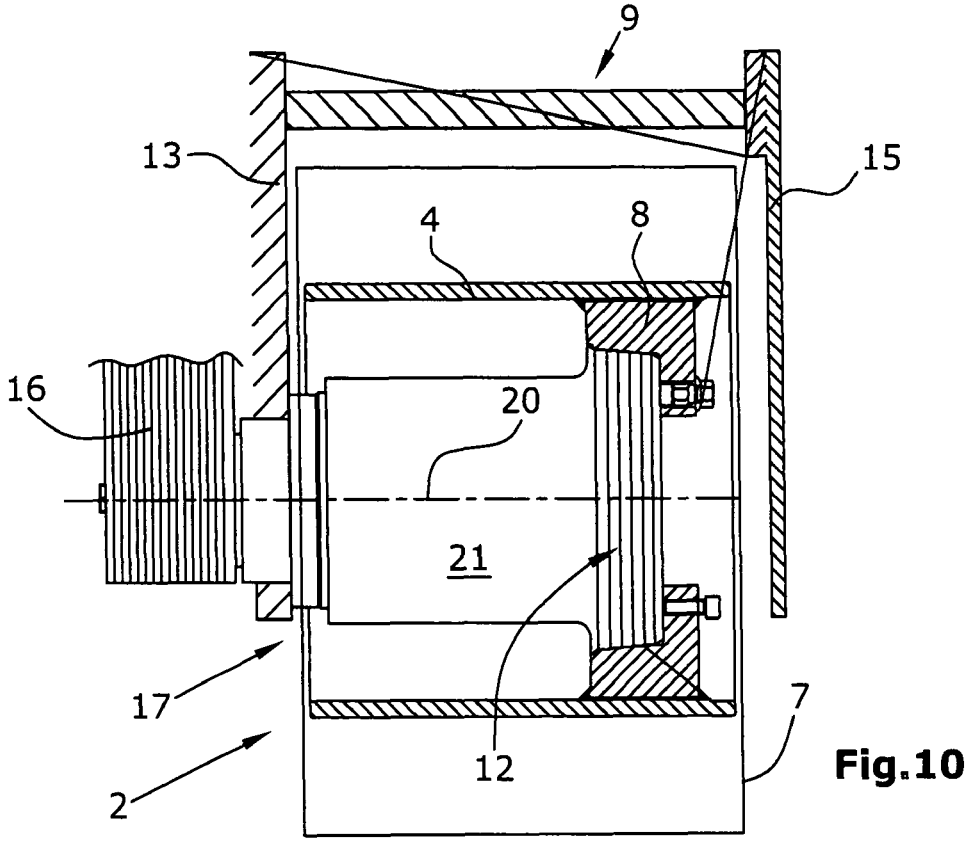
FIG. 10 an embodiment for a one-sided mounting or floating mounting respectively of the milling tube.

The support ring mount 12 may comprise a single-part ring, as can be seen from FIG. 2, or else may be integral with the output housing 21 of the gearbox unit 17, as is shown in the embodiments of FIGS. 9 and 10.

Figure 5:
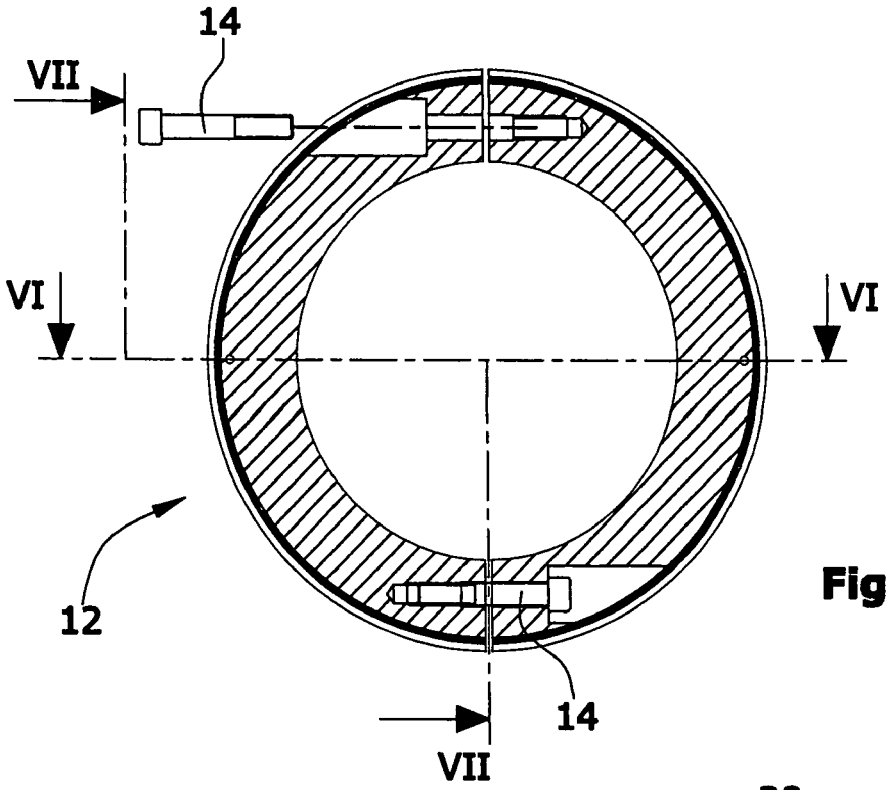
FIG. 5 a two-part support ring mount.
Figure 6:
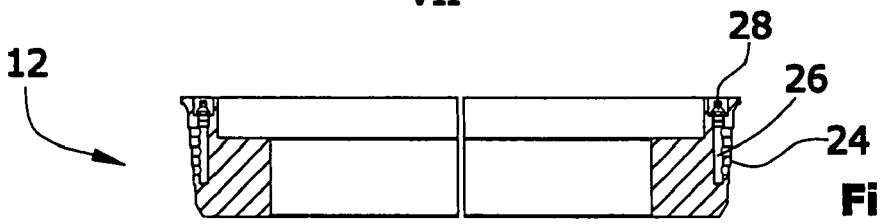
FIG. 6 a section along the line VI-VI in FIG. 5.
Figure 8:
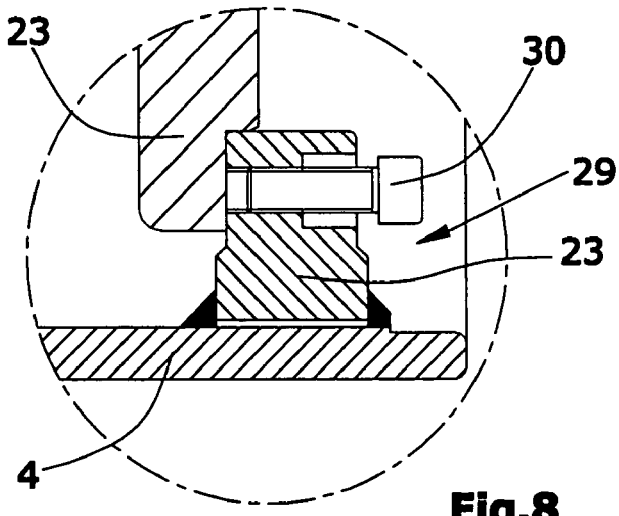
FIG. 8 a push-off device in accordance with the enlarged detail VIII in FIG. 2.

As can be seen from FIGS. 5 and 6, the support ring mount 12 may alternatively comprise a multi-part, in FIGS. 5 and 6 two-part, ring that is suitable for being mounted on a rotating body, such as, for instance, the output housing 21 of the gearbox unit 17.

The support ring mount 12 may also be mounted on a rotating body in a movable manner axially, as is possible in the embodiments in FIGS. 2 to 4, or may be mounted on the rotating body in an immovable manner axially, as can be seen from the embodiments in FIGS. 9 and 10.

Mounting bolts 14 can be seen in FIG. 5, by means of which the support ring mount 12 can be mounted on a rotating body. It is understood that the rotating body may also comprise an annular flange or connecting flange and need not necessarily be an output housing 21 or a basic drum body 19.

FIG. 6 is a section along the line VI-VI in FIG. 5, wherein the section runs through the injection duct 26.

Figure 7:
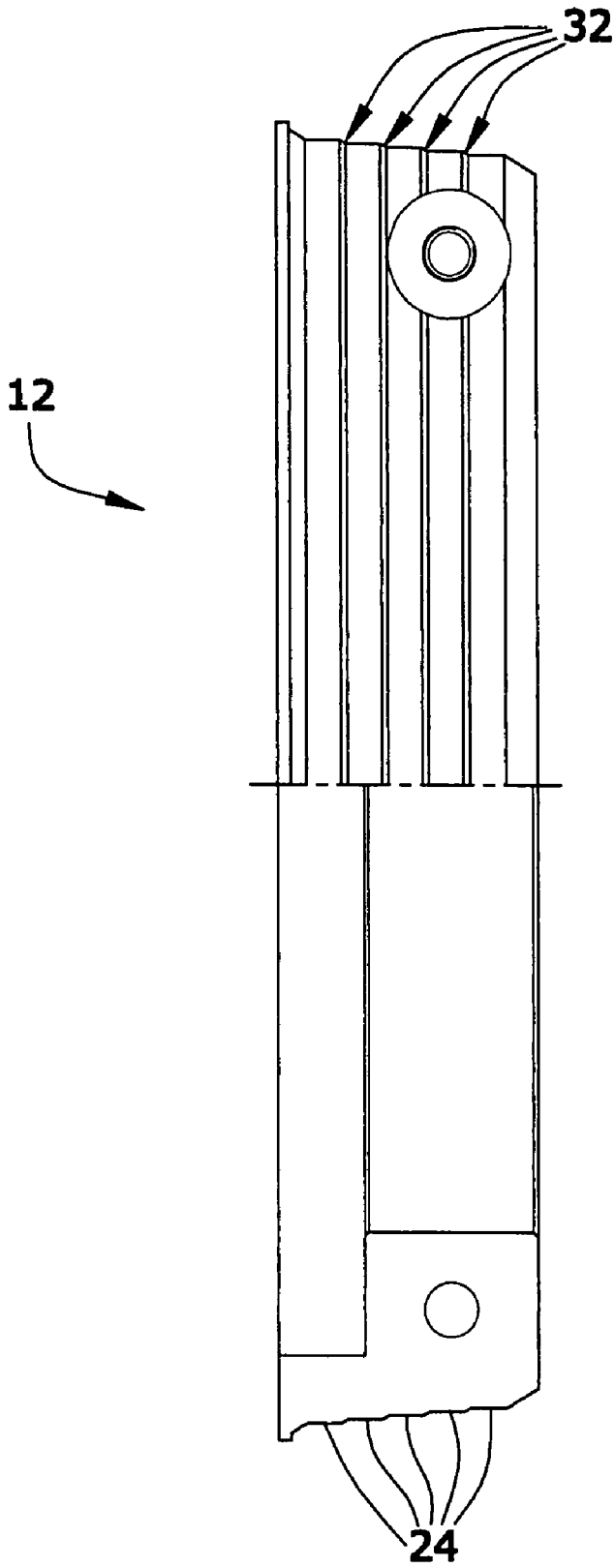
FIG. 7 a half-section of the support ring in the direction of the arrows VII in FIG. 5.

FIG. 7 shows a side view of the support ring mount 12 along the line VII-VII in FIG. 5.

A mechanical push-off device 29 is shown in FIG. 7, which allows the milling tube 4 to be pulled from its mounted position on the support ring mount 12 by means of bolts 30.

To do this, the bolts 30 are screwed against the mounting flange 23, which allows the milling tube 4 of the milling drum 2 to be pulled.

It can also be seen from FIG. 7 that one chamfer 32 each of less than 45° is provided between the supporting surfaces 24 of the support ring mount 12 at the junctions of the individual steps, which facilitates assembling and centering of the milling tube 4. Corresponding chamfers 32 are also provided between the supporting surfaces 22 of the support ring 8.

The supporting surfaces 22, 24 are arranged concentrically, preferably coaxially, to the axis 20 of the milling drum. One step between the supporting surfaces 22, 24 has a height of, for instance, 1 to 4 mm, with an increment between steps of 2 mm having turned out to be of particular advantage.

The invention claimed is:

1. Milling drum for a construction machine, with an interchangeable milling tube arranged coaxially to a rotational axis of the milling drum, where the milling tube is supported by a support ring on a support ring mount of a rotating body coupled to a milling drum drive, characterized in that, the support ring and the support ring mount of the rotating body include at least three complementary supporting surfaces arranged concentrically to the axis of the milling drum, where the said supporting surfaces have different supporting circle diameters and are arranged behind one another axially with their diameters decreasing incrementally in a pulling direction.

2. Device in accordance with claim 1, characterized in that at least five supporting surfaces are arranged behind one another axially.

3. Device in accordance with claim 1, characterized in that the supporting surfaces have an axial length of 5 to 40 mm.

4. Device in accordance with claim 1, characterized in that the supporting surfaces is have equal lengths in axial direction.

5. Device in accordance with claim 1, characterized in that the supporting surfaces have different lengths in axial direction, in such a manner that the length of the supporting surfaces decreases in accordance with the decreasing supporting circle diameter.

6. Device in accordance with claim 1, characterized in that the supporting surfaces of the support ring are offset axially in relation to the supporting surfaces of the support ring mount in such a manner that annular chambers are formed at junctions of the individual steps.

7. Device in accordance with claim 6, characterized in that the annular chambers are suitable for being filled with an anti-corrosive agent and/or a lubricant.

8. Device in accordance with claim 6, characterized in that the annular chambers are connected with an injection duct for injecting an anti-corrosive agent and/or a lubricant.

9. Device in accordance with claim 1, characterized in that the supporting surfaces are coated with a gliding layer.

10. Device in accordance with claim 1, characterized in that the support ring mount comprises a single-part ring.

11. Device in accordance with claim 1, characterized in that the support ring mount comprises a multi-part ring that is suitable for being mounted on the rotating body.

12. Device in accordance with claim 1, characterized in that the support ring mount is mounted on the rotating body in an immovable manner axially.

13. Device in accordance with claim 1, characterized in that the support ring mount is mounted on the rotating body in a movable manner axially.

14. Device in accordance with claim 1, characterized in that the rotating body is a drum body for supporting the milling tube and/or an output housing of a gearbox unit of the milling drum drive.

15. Device in accordance with claim 1, characterized in that the milling drum is mounted in a removable side wall and the support ring of the milling tube rests upon the support ring mount of the rotating body, where the milling drum can be pulled from the support ring mount of the rotating body in the pulling direction after the side wall has been removed.

16. Device in accordance with claim 15, characterized in that the drum body is coupled with the milling drum drive and supports the end of the milling tube facing the side wall.

17. Device in accordance with claim 14, characterized in that the milling tube includes a mounting flange attached to the drum body and supported by the drum body.

18. Device in accordance with claim 1, characterized in that a push-off device engages with the milling tube or with the rotating body, which push-off device permits the milling tube to be pulled from its mounted position in the pulling direction for the purpose of disassembly.

19. Device in accordance with claim 18, characterized in that the push-off device of comprises push-off screws that are arranged in a mounting flange of the milling tube.

20. Device in accordance with claim 18, characterized in that the push-off device comprises a hydraulic appliance.

21. Device in accordance with claim 20, characterized in that the hydraulic appliance acts upon a front end of the milling tube from a side wall on a gearbox side.

22. Device in accordance with claim 20, characterized in that the hydraulic appliance acts upon the drum body from a mounting flange of the milling tube.

23. Device in accordance with claim 1, characterized in that the supporting surfaces arranged behind one another axially with different supporting circle diameters, include a chamfer at junctions of the individual steps.

24. Construction machine, in which a milling drum is mounted in accordance with claim 1.

25. Gearbox unit for a road milling machine or a recycler with a rotating output housing, where an interchangeable milling tube of a milling drum is supported by a support ring on a support ring mount of the rotating output housing characterized in that the support ring and the support ring mount of the rotating output housing include at least three complementary supporting surfaces arranged concentrically to the axis of the milling drum, where the said supporting surfaces have different supporting circle diameters and are arranged behind one another axially with their diameters decreasing incrementally in a pulling direction of the milling tube.

26. Device in accordance with claim 2, characterized in that the supporting surfaces have an axial length of 5 to 40 mm.

27. Device in accordance with claim 7, characterized in that the annular chambers are connected with an injection duct for injecting an anti-corrosive agent and/or a lubricant.

28. Device in accordance with claim 1, characterized in that the supporting surfaces have an axial length of 10 to 20 mm.

29. Device in accordance with claim 1, characterized in that the supporting ring mount is integral with the rotating body.

30. Device in accordance with claim 23, wherein the chamfer is less than 45°.

31. A construction machine, comprising:

a milling drum;

a milling drum drive;

a supporting ring connected to the milling drum and including first, second and third support ring surfaces having first, second and third successively decreasing support surface diameters, respectively; and a support ring mount connected to the milling drum drive and including first, second and third support ring mount surfaces complementary to the support ring surfaces so that the support ring mount surfaces can be received within the support ring surfaces and so that the support ring can be pulled axially from the support ring mount in a pulling direction of the decreasing diameters.

32. The machine of claim 31, wherein:

the support ring includes fourth and fifth support ring surfaces having successively decreasing support surface diameters; and the support ring mount includes fourth and fifth support ring mount surfaces complementary to the fourth and fifth support ring surfaces.

33. The machine of claim 31, wherein:

the support ring surfaces each have an axial length in a range of from about 5 mm to about 40 mm.

34. The machine of claim 31, wherein:

the support ring surfaces each have an axial length in a range of from about 10 mm to about 20 mm.

35. The machine of claim 31, wherein:

the support ring surfaces have equal axial lengths.

36. The machine of claim 31, wherein:

the support ring surfaces have different axial lengths, with smaller diameter surfaces having shorter axial lengths.

37. The machine of claim 31, wherein:

the support ring surfaces are axially offset from the support ring mount surfaces to form annular chambers at junctions of adjacent support ring surfaces.

38. The machine of claim 37, further comprising:

a lubrication passage communicated with the annular chambers.

* * * * *

UNITED STATES PATENT AND TRADEMARK OFFICE

CERTIFICATE OF CORRECTION

PATENT NO. : 7,901,011 B2
APPLICATION NO. : 11/727989
DATED : March 8, 2011
INVENTOR(S) : Holl et al.

It is certified that error appears in the above-identified patent and that said Letters Patent is hereby corrected as shown below:

Column 5, line 46, delete “is” after --surfaces--.
Column 6, line 32, delete “of” after --device--.

Signed and Sealed this
Seventeenth Day of May, 2011

David J. Kappos

David J. Kappos
*Director of the United States Patent and Trademark Office*